US005797525A

United States Patent [19]

McLelland et al.

[11] Patent Number: 5,797,525

[45] Date of Patent: *Aug. 25, 1998

[54] NESTABLE POURING SPOUT ASSEMBLY

[75] Inventors: Douglas M. McLelland, Ft. Wayne; Robert E. Magley, Waterloo, both of Ind.

[73] Assignee: Rieke Corporation, Auburn, Ind.

[ * ] Notice: The term of this patent shall not extend beyond the expiration date of Pat. No. 5,641,099.

[21] Appl. No.: 856,633

[22] Filed: May 14, 1997

Related U.S. Application Data

[63] Continuation of Ser. No. 569,920, Dec. 8, 1995, Pat. No. 5,641,099.

[51] Int. Cl.[6] ..... B67D 3/00

[52] U.S. Cl. ..... 222/530; 222/541.9

[58] Field of Search ..... 222/153.06, 153.07, 222/153.14, 529, 530, 541.9, 570; 220/257, 258, 270

[56] References Cited

U.S. PATENT DOCUMENTS

| | | | |
|---|---|---|---|
| 3,042,271 | 7/1962 | Winstead . | |
| 3,093,273 | 6/1963 | Borah . | |
| 3,613,966 | 10/1971 | Summers . | |
| 3,986,646 | 10/1976 | Strub . | |
| 4,236,629 | 12/1980 | Dwinell . | |
| 4,294,382 | 10/1981 | Summers et al. . | |
| 4,422,563 | 12/1983 | Babiol . | |
| 4,442,949 | 4/1984 | Dwinell et al. . | |
| 4,555,048 | 11/1985 | Hamman et al. . | |
| 4,568,006 | 2/1986 | Mueller et al. . | |
| 4,569,464 | 2/1986 | Wassilieff . | |
| 4,618,078 | 10/1986 | Hamman et al. . | |
| 4,632,282 | 12/1986 | Nagashima . | |
| 4,706,829 | 11/1987 | Li . | |
| 4,773,560 | 9/1988 | Kittscher . | |
| 4,917,268 | 4/1990 | Campbell et al. . | |
| 4,917,270 | 4/1990 | Simon . | |
| 5,004,126 | 4/1991 | Klesius . | |
| 5,088,632 | 2/1992 | Odet et al. . | |
| 5,108,009 | 4/1992 | Davidson et al. . | |
| 5,641,099 | 6/1997 | McLelland et al. | 222/530 |
| B1 4,618,807 | 4/1988 | Hamman et al. . | |

FOREIGN PATENT DOCUMENTS

| | | |
|---|---|---|
| 0144829 | 6/1986 | European Pat. Off. . |
| 0216268 | 4/1987 | European Pat. Off. . |
| 0320808 | 6/1989 | European Pat. Off. . |
| 417453 | 3/1991 | European Pat. Off. . |
| 0498954 | 8/1992 | European Pat. Off. . |
| 0524408 | 1/1993 | European Pat. Off. . |
| 0620160 | 10/1994 | European Pat. Off. . |
| 40 01 824 | 7/1990 | Germany . |

*Primary Examiner*—Philippe Derakshani

*Attorney, Agent, or Firm*—Woodard, Emhardt, Naughton, Moriarty & McNett

[57] ABSTRACT

An all-plastic closure for snap-fit attachment to a raised neck finish of a plastic container for closing the container includes a unitary dispensing spout, a threaded closing cap, and a unitary outer ring which is attached to the closing cap by a plurality of frangible elements. The neck finish of the container has a substantially cylindrical inner surface defining a container opening wherein the upper outer edge of the neck finish is configured with an outwardly extending lip portion and a recessed area therebeneath which is used for interlocking and snap-fit engagement with the all-plastic closure. The dispensing spout is moveable back and forth between a nested position and an extended position and includes an outer flange with annular inner and outer walls which are joined by an upper wall and which together define an inverted annular channel. The unitary outer ring is assembled onto and around the outer flange with a snap-fit arrangement. The annular channel of the outer flange is designed to snap over and around the raised neck finish whereby the annular inner and outer walls are sized relative to the raised neck so as to create a compressive fit against the raised neck for establishing a liquid-tight interface between the closure and the container. The closure is made tamper-evident by the presence of the frangible elements.

22 Claims, 4 Drawing Sheets

NESTABLE POURING SPOUT ASSEMBLY

REFERENCE TO RELATED APPLICATIONS

The present patent application is a continuation patent application of application Ser. No. 08/569,920, filed Dec. 8, 1995, now U.S. Pat. No. 5,641,099.

BACKGROUND OF THE INVENTION

This invention relates generally to a closure system for a container that includes a cap and spout assembly for snap-on receipt by a container neck. More specifically, the present invention relates to a cap and spout assembly and a method for assembling the cap and spout assembly onto a container wherein the cap and spout assembly includes a snap-on tamper evident cap and a snap-on pouring spout.

Many types of closures for sealing onto a container neck are known that include a spout received onto the neck of a container and a cap for closure of the spout. Typically, the cap is threaded onto the spout, and the spout and/or cap is either threaded into the container neck finish or clamped around the container neck finish via a separate crimping ring. For example, U.S. Pat. Nos. 4,236,629 to Dwinell, 4,632,282 to Nagashima and 4,568,006 to Mueller, et al. disclose various crimping ring arrangements for clamping the spout onto the container neck, wherein the crimping ring is constructed of a malleable metal. One disadvantage of this type of closure is that the metal crimping ring cannot be recycled together with the various plastic components and, therefore, must be removed from each container prior to recycling. Another disadvantage is that an additional assembly step is required to assemble the crimping ring onto the spout prior to assembly of the cap.

As another example of a closure that seals onto a container neck, U.S. Pat. No. 5,004,126 to Klesius discloses a plastic closure for a plastic container that includes a frame cap adapted to be screwed onto an externally threaded container neck over a flexible pouring spout. The frame cap is frangibly attached to and integral with a screw-on ring adapted to be threaded onto the externally threaded container neck. One disadvantage of this type of closure is the possibility of breaking the frame cap from the screw-on ring during threading of the ring onto the container neck. Although a flexible web is provided between the cap and ring to absorb excessive threading forces, excessive radial forces beyond those accommodated by the flexible web can nevertheless still result during assembly of the cap and ring onto the container neck so as to break the frangible cap and ring attachment, thereby defeating its tamper-evident function. Also, in many applications the tolerances of the container neck are not tightly controlled and depending on the tolerance stack of the cap, spout and container neck, the spout may prematurely seat onto the container neck such that continued threading of the ring onto the container neck breaks the frangible cap and ring attachment.

Other closures that seal onto a container neck include a snap-on spout received onto the container neck and a cap threaded onto the container neck over the snap-on spout. For example, U.S. Pat. No. 4,917,270 to Simon discloses a closure device that includes a spout received into a groove provided on the container neck, wherein the spout resiliently deforms over the container neck during installation to seat in the groove. U.S. Pat. Nos. 5,108,009 to Davidson et al. and 4,706,829 to Li disclose other similar interlocking spout and container neck configurations. Still, there is always a need for an improved snap-on closure for universal use with a variety of spouts.

For example, both the Li and Davidson et al. closures include a stiff spout constructed of a relatively hard plastic that is molded to a fixed configuration. As such, the spout alone provides the necessary resilient interlocking force required to seal onto the container neck, so that the cap is not required to enhance the spout/container neck seal and can therefore be entirely removed from the container neck. Other more flexible spouts present additional sealing problems beyond those addressed by the Simon, Davidson, et al. and Li closures.

Considering the Davidson, et al. patent in greater detail, the FIG. 7 and FIG. 8 illustrations might appear to have some similarity to the present invention due in part to the arrangement of the components relative to the neck of the container. Additionally, the specification makes mention of a sealing ridge 113 which is provided on an upper end portion of the outer peripheral surface of the cylindrical wall 106. There are, however, a number of significant differences between the dispensing and measuring package disclosed in the Davidson, et al. patent and the present invention. First of all, the present invention is directed to the snap fit assembly of a spout-type closure onto a raised cylindrical neck of a plastic container. Unlike Davidson, et al., the present invention does not threadedly install the outer cap onto the neck finish. The interior surface of the neck finish is a straight cylinder, without any modifications or shaping. Unlike the present invention, the Davidson, et al. package does not include a nestable and extendable pouring spout with a center portion externally threaded so as to receive a threaded cap. Further, the Davidson, et al. package does not include an outer ring which is snapped over an outer flange of the spout which in turn is snapped over the raised neck finish of the container. The Davidson, et al. package would appear to be a specifically styled disposable package for one product of one company. In contrast, the present invention is addressing the need for a snap-fit closure assembly which would be suitable for use with a variety of containers coming from different manufacturers.

To some extent, flexible pour spouts that are movable between a nested position and an extended position are more prone to leakage at the spout/container neck interface than are rigid spouts. As a result, flexible spouts typically require additional means for maintaining the spout/container neck seal when the cap is removed from the spout. See, for example, European Patent Application No. EPO 320 808 A1 which discloses a spout having a U-shaped flange flexibly received over a conical container flange and a retaining ring flexibly received onto the spout. The spout is assembled onto the container neck prior to assembly of the cap. One drawback of this configuration is that the sequential assembly potentially leaves the contents of the container accessible to tampering or contamination. If the cap and spout are assembled together, too much force is required to assemble the cap and spout over the container flange since both the U-shaped flange of the spout and the ring of the cap must resiliently flex over the same container flange. If the cap and spout are constructed of a less resilient plastic to facilitate simultaneous assembly, the assembled cap and spout are then more prone to leakage at high internal container pressures.

Another drawback with other plastic closures which try to establish a liquid-tight interface is their tendency to turn in or relative to the container opening. This is likely to occur when the closure cap is threaded back onto the spout and is tightened in position. The tightening torque may be sufficient to overcome the "grip" of the closure on the container opening and thereby allows relative rotation between the two. Even if this relative rotation does not actually result in or signify leakage, it is a negative from the consumer's perspective as they believe such movement denotes a likelihood of leakage.

Therefore, a need exists for an improved closure for sealing receipt onto a container neck that overcomes the deficiencies of the above-described closures. Such a closure should provide improved sealing characteristics for high internal container pressures, such as that resulting from impact or dropping of the container, while still being easily assembled together onto the container neck. Preferably, the closure should be constructed entirely of plastic and easily molded to facilitate manufacturing. The closure should be tamper evident and also easily installed onto a container neck without risk of damage to the tamper evident means.

Over the past few years there has been a push toward designs in this general field of technology which are ecologically responsible. Customers of closure products often express a desire for designs which can be recycled. For example, all-plastic spouts and either all-plastic or all-metal containers have become the designs of choice. After reviewing the existing designs, it was learned by the present inventors that tighter tolerances for the particular container opening design are required. It was also discovered that existing manufacturers of these containers typically use different tooling designs and different processes to create the container opening which is intended to receive the closure spout. This has led to several different configurations now on the market for the same basic opening design. Ideally a closure spout designed for a particular opening design would be suitable for a proper fit and assembly with any of the different configurations which might be encountered in the marketplace. To date, this has not been a problem because the existing designs incorporate a metal crimp ring which creates the necessary seal. However, many customers would prefer to have an all-plastic spout/closure assembly for the benefits and advantages of the aforementioned recycling. An all-plastic design makes it much easier to recycle and this is becoming more important as companies become more sensitive to ecology issues.

The present invention provides an all-plastic, tamper-evident spout and cap combination which meets the current market needs in a novel and unobvious way. A unique sealing configuration enables the cap and spout to be pre-assembled and then snapped onto the container neck finish. The combination is suitable for container necks which have minor shape and tolerance variations.

SUMMARY OF THE INVENTION

An all-plastic closure for snap-fit attachment to a raised neck finish of a container, the neck finish having a substantially cylindrical inner surface defining a cylindrical opening and having a radially-extending lip portion with an annular recessed area axially beneath said lip portion, the closure comprising a unitary nestable and extendable dispensing spout having an outer flange, a centertube portion through which container contents are dispensed, and a connecting body portion disposed between the outer flange and the centertube portion, the outer flange including inner and outer walls joined by an upper wall which together define an inverted annular channel and the centertube portion being threaded. The closure further includes a unitary, threaded closing cap which is arranged and constructed to be threadedly assembled onto the centertube portion for closing the dispensing spout and a unitary outer ring assembled onto and around the outer flange with a snap-fit arrangement. According to one embodiment of the present invention, the annular channel of the outer flange is designed and constructed to snap over and around the raised neck finish, the inner and outer walls being sized relative to the raised neck so as to create a compressive fit against the raised neck for establishing a liquid-tight interface between the closure and the container.

One object of the present invention is to provide an improved all-plastic closure for snap-fit attachment onto a raised neck finish of a container.

Related objects and advantages of the present invention will be apparent from the following description.

DESCRIPTION OF THE PREFERRED EMBODIMENT

Figure 1:
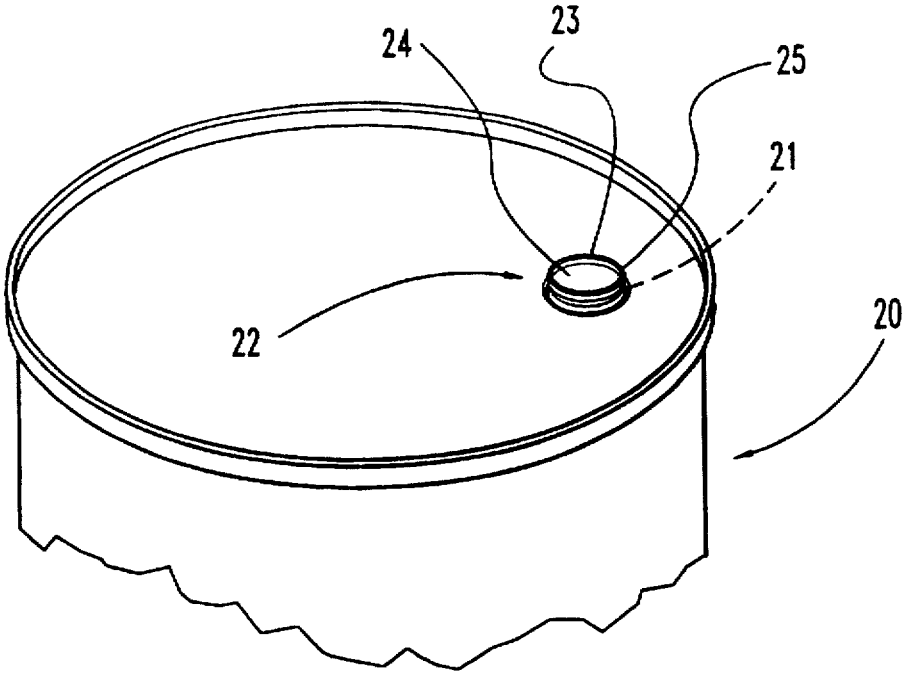
FIG. 1 is a perspective view of a plastic closure as installed in the outlet opening of a container according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a plastic container 20 which includes an outlet opening 21 fitted with an all-plastic closure 22. In the preferred embodiment, the container 20 is a five-gallon pail. The closure 22 includes a nestable and extendable externally-threaded pouring spout 23 which has a snap-fit assembly onto the raised neck finish which defines outlet opening 21. The closure 22 (see FIGS. 2 and 3) also includes a threaded cap 24 which is initially integrally joined to a surrounding, outer ring 25 by a tamper-evident arrangement. Spout 23 includes an inner cylindrical wall which is externally threaded while cap 24 includes a cylindrical outer wall 27 which is internally threaded. In this manner, cap 24 is able to be threaded onto the pouring spout 23 for closing the spout and to be unscrewed from the spout when access to the contents of the container are desired. The radially-outward and surrounding outer ring 25 snaps over a radially outer portion of spout 23 which in turn is secured to the raised neck finish defining outlet opening 21. A pair of oppositely disposed bail handles 24*a* and 24*b* are pivotally hinged to cap 24 and in turn each bail handle is connected to a corresponding interior edge of outer ring 25 by a corresponding series of frangible elements 28. Series 28*a* connects bail handle 24*a* to outer ring 25 and series 28*b* connects bail handle 24*b* to the outer ring. Each bail handle 24*a* and 24*b* includes a centered radially extending lifting tab 26*a* and 26*b*, respectively, and outer ring 25 is notched at two oppositely-disposed locations 25*a* and 25*b* which provide clearance for the two bail handle lifting tabs 26*a* and 26*b*, respectively. The lifting tabs are circumferentially centered in their corresponding series of frangible elements.

Figure 2:
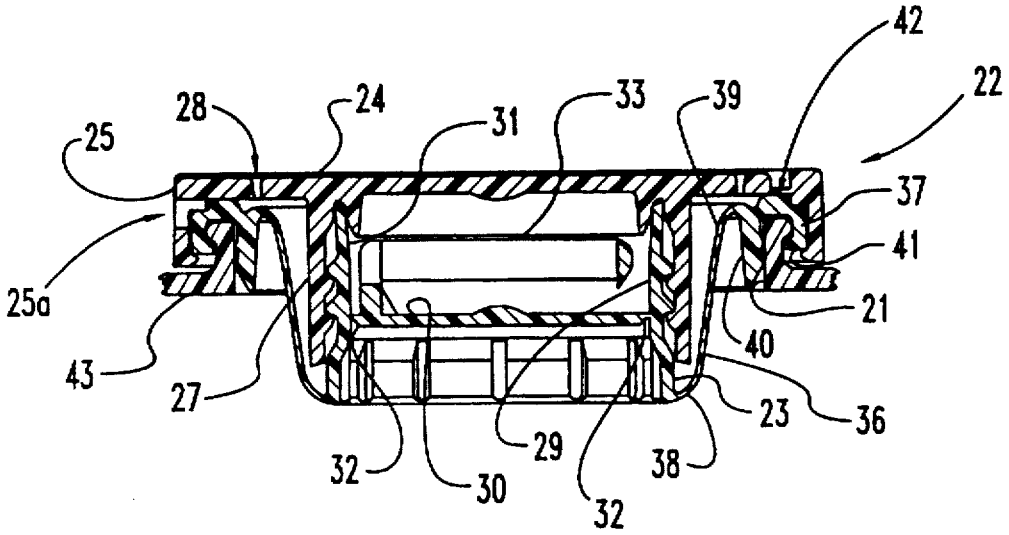
FIG. 2 is a side elevational view in full section of the FIG. 1 closure.
Figure 3:
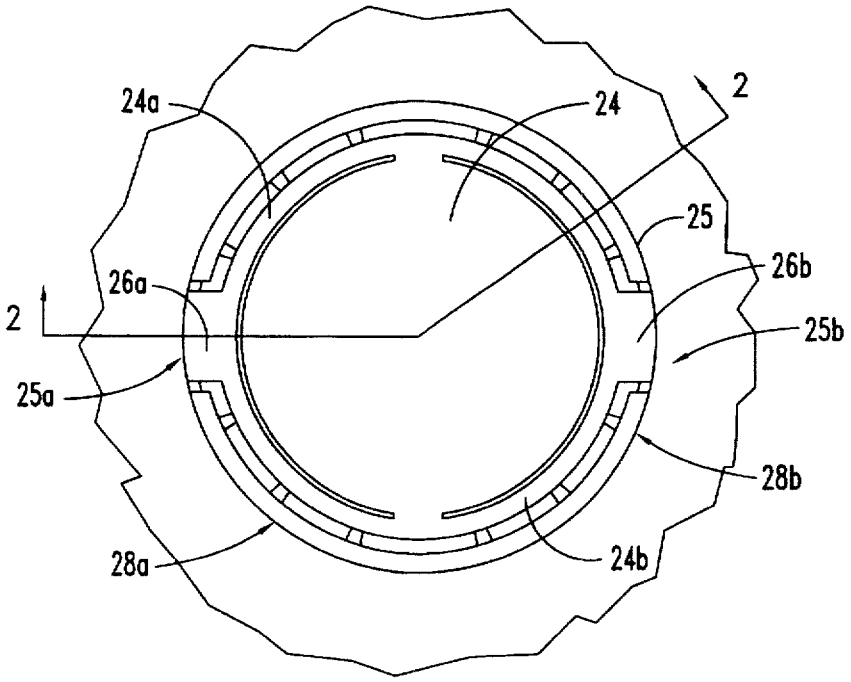
FIG. 3 is a top plan view of the FIG. 1 closure.

Referring more specifically to FIGS. 2 and 3, closure 22 is an annular assembly of all-plastic components which makes the overall design attractive from a recycling perspective. The spout 23 includes a generally cylindrical, hollow center tube portion 29 which is initially closed by tear-out diaphragm 30. Diaphragm 30 is connected to the inner surface 31 of portion 29 by a thin circumferential web 32. Pull ring 33 is used to sever web 32, thereby allowing the diaphragm 30 to be removed and discarded. The outer surface of portion 29 is externally threaded for the threaded receipt of outer wall 27, as previously described. As should be understood, once the diaphragm 30 is torn out, the contents of container 20 are able to be accessed. In order to control the dispensing of the contents and to prevent contamination therewith, removable cap 24 is applied to close off the center portion 29.

Spout 23 includes an annular outer wall portion 36 which in the nested orientation of FIG. 2 extends upwardly and outwardly into securing flange 37. Spout 23 is of a unitary construction and includes a first invertible fold 38 positioned between wall 36 and portion 29 and a second invertible fold 39 positioned between wall 36 and flange 37. These two invertible folds enable the spout 23 to be extended into a pouring orientation as is known in the relevant art and thereafter returned to the nested orientation.

Securing flange 37 snaps over and around the raised neck finish which defines outlet opening 21 with a secure, liquid-tight fit. Flange 37 includes an annular inner wall 40 and radially-spaced therefrom an annular outer wall 41. Connecting wall 42 in combination with walls 40 and 41 defines an inverted annular channel 44 which receives raised cylindrical wall 43. Wall 43 represents the raised neck finish of container 20 which defines outlet opening 21.

The connection of outer ring 25 to the two bail handles 24*a* and 24*b* by the series of frangible elements 28 is the reason outer ring 25 can be considered a tamper-evident ring. In order to open cap 24, it needs to be unscrewed and this may be done in either a nested or extended position of spout 23. Since there is a tight interference fit of outer ring 25 onto securing flange 37 and in turn an interlocked assembly onto wall 43, it is not possible to rotate cap 24 nor raise spout 23 without first breaking the frangible elements. This then provides a visual indication of any possible tampering attempt relative to closure 22. Once the frangible elements 28 are broken, the bail handles are able to be pivoted upwardly and then used to extend the spout 23. Even after the frangible elements 28 are broken, the outer ring 25 remains tightly secured over and around flange 37 and wall 43 to help maintain the requisite liquid-tight seal.

FIG. 3 provides a top plan view of the FIG. 2 assembly and more clearly illustrates the shape and location of the two bail handles 24*a* and 24*b* and the two series 28*a* and 28*b* of frangible elements 28. The FIG. 2 section view is taken along line 2—2 in the direction of the arrows. A careful review of the FIG. 2 and FIG. 3 illustrations will also indicate the location and arrangement of the finger lift tabs 26*a* and 26*b* associated with bail handles 24*a* and 24*b*. It will also be seen that outer ring 25 is notched at two locations 25*a* and 25*b* and that the finger lift tabs are positioned in these notches. There is clearance left below each finger lift tab for a finger or fingernail to be inserted in order to lift the bail handles. The annular and substantially concentric arrangement of the outer ring 25, cap 24, and the combined bail handles 24*a* and 24*b* are best illustrated in FIG. 3.

Figure 4:
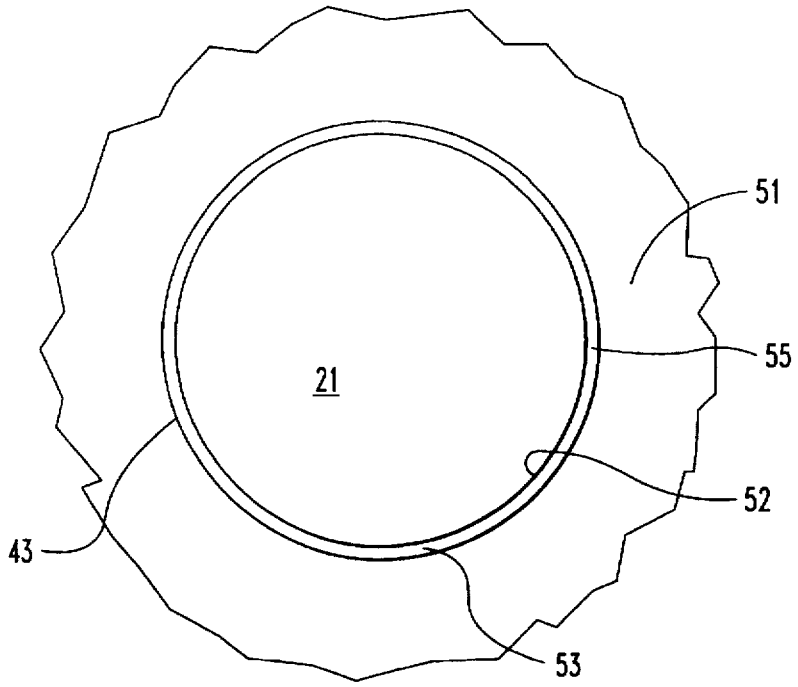
FIG. 4 is a top plan view of the FIG. 1 outlet opening.
Figure 5:
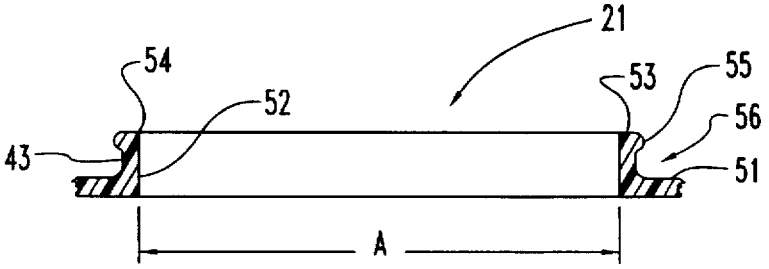
FIG. 5 is a side elevational view in full section of the FIG. 4 outlet opening.

Referring to FIGS. 4 and 5, the outlet opening 21 and the raised, surrounding annular wall 43 which defines opening 21 are illustrated in greater detail. Wall 43 is a molded, unitary extension of contained end 51 and extends axially for approximately 0.32 inches (0.81 cm). The inside substantially cylindrical surface 52 is a smooth surface and top surface 53 is substantially planar. Surface 52 is the primary sealing area for spout 23 and defines substantially cylindrical outlet opening 21. Adjacent upper edge 54 is a radially-extending, over-hanging lip 55 which has a rounded outer surface. Recessed area 56 is disposed beneath and inwardly of lip 55 and is axially located between lip 55 and container end 51.

Figure 6:
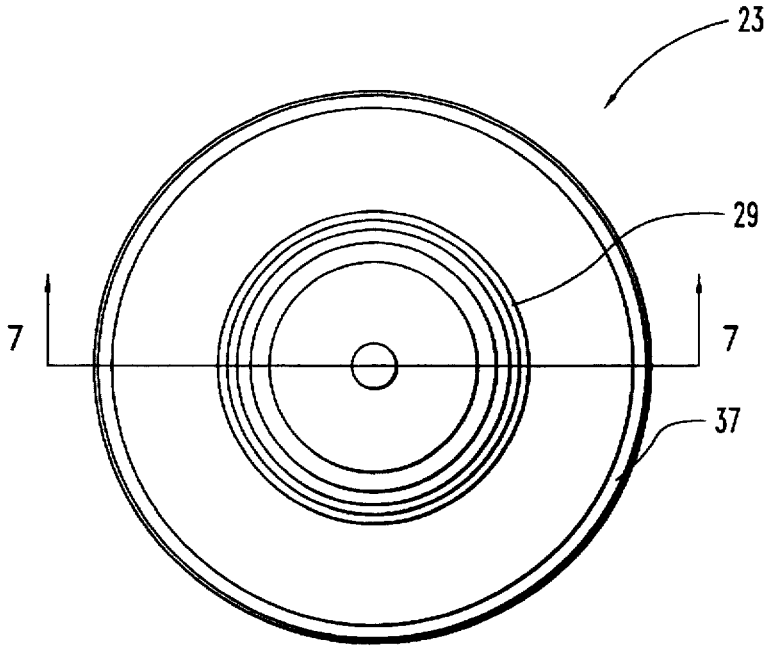
FIG. 6 is a top plan view of a spout which comprises one portion of the FIG. 1 closure.
Figure 7:
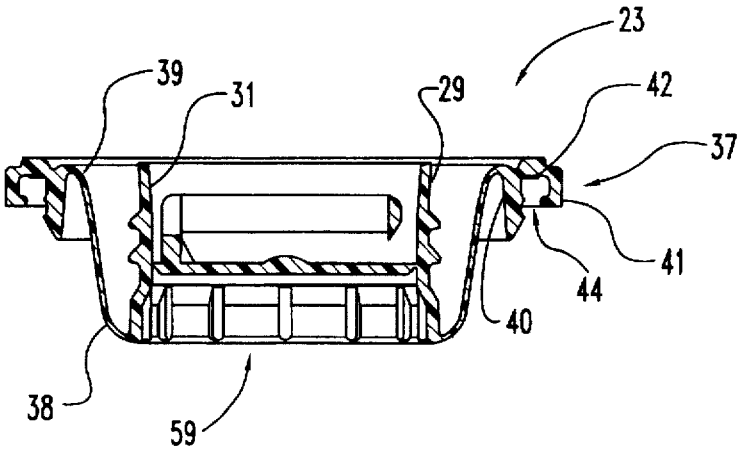
FIG. 7 is a side elevational view in full section of the FIG. 6 spout.

Referring to FIGS. 6 and 7, the spout 23 is illustrated in greater detail. While the FIG. 7 drawing is virtually identical to the FIG. 2 drawing, the cap 24, the outer ring 25, and the outlet opening 21 (including wall 43) have all been removed. This drawing simplification allows some of the features of the spout 23 to be more clearly illustrated, including the specific geometry of securing flange 37 and the shape of inner and outer walls 40 and 41, and their cooperating relationship.

The lower portion of portion 29 which is that region below the diaphragm 30 includes a series of equally-spaced stiffening ribs 59. This spout 23 could also be provided with a self-venting feature designed and configured in accordance with U.S. Pat. No. 4,618,078 (and its B1 Reexamination Certificate), which issued Oct. 21, 1986 to Martin E. Hamman et al. and which patent is hereby expressly incorporated by reference for its entire disclosure. This self-venting feature is an optional feature and does not affect the primary focus of the present invention which is directed to securing flange 37 and the assembly of flange 37 onto wall 43 and the assembly of the outer ring 25 onto flange 37. As described, annular wall 43 fits up into inverted channel 44. Since walls 40, 41, and 42 establish a sealed interface against wall 43, the specific geometry of the interior surfaces of walls 40, 41, and 42 is important.

Figure 8:
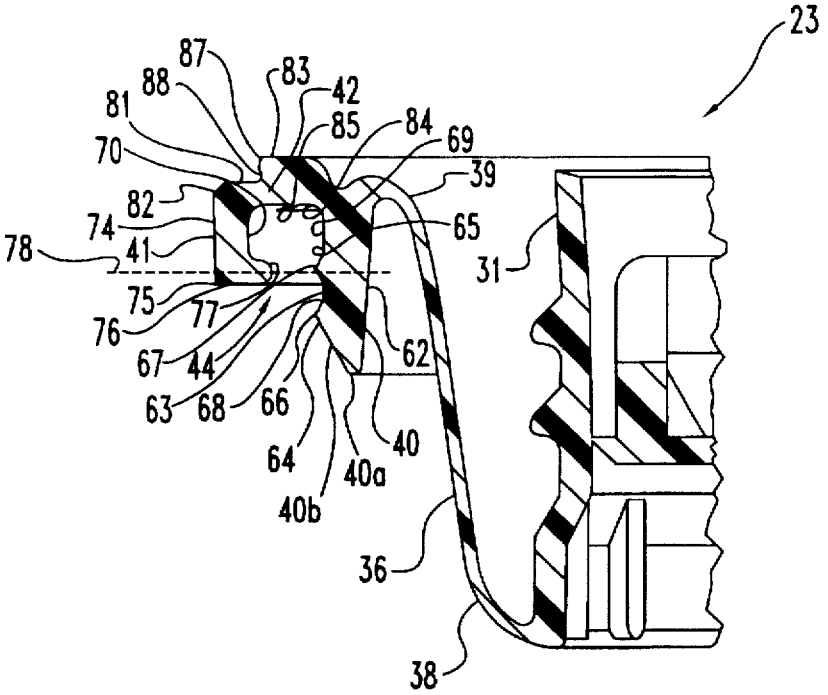
FIG. 8 is a partial, enlarged side elevational view of the FIG. 7 spout.
Figure 9:
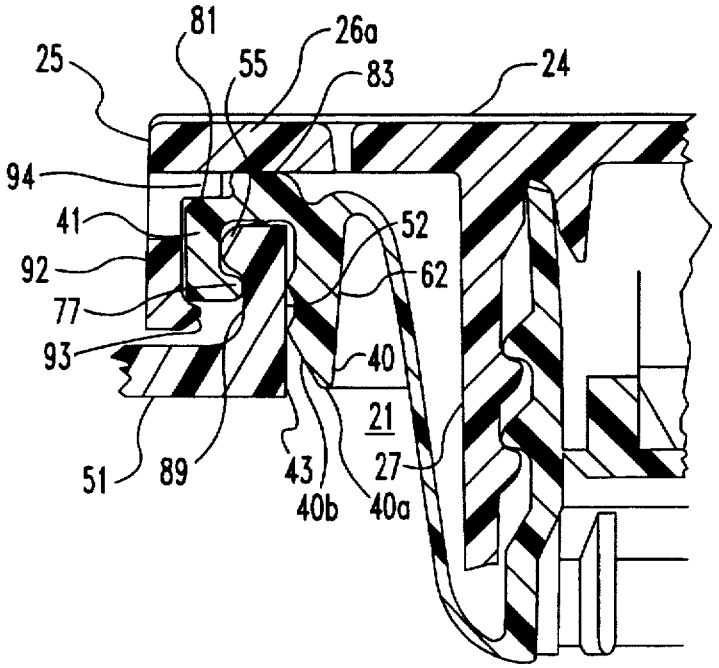
FIG. 9 is a partial, enlarged side elevational view of the FIG. 8 spout as received in the outlet opening and with a cap and outer ring combination assembled thereto.

Referring now to FIGS. 8 and 9, inner wall 40 includes a first surface 62 which faces outer wall portion 36 and opposite thereto a second surface 63 which faces inverted channel 44. The lower tip 40*a* of wall 40 has a tapered (conical) shape and an annular, inclined surface 40*b* which provides a sure and convenient lead-in to outlet opening 21. This tapered shape provides a smaller entry diameter for wall 40 and precludes any abutment interference between wall 40 and the outlet opening. Surface 63 is shaped with two spaced-apart annular lips 64 and 65. In lateral section, each annular lip has the appearance of being part-circular with a centered and outwardly protruding tip 66 and 67, respectively. The part-circular form of each lip 64 and 65 extends radially outwardly and the recessed portion 68 between the two lips is curved and smoothly transitions into lips 64 and 65. Annular portion 69 is substantially cylindrical and is substantially parallel (i.e., concentric) to annular portion 70 disposed on outer wall 41.

Outer wall 41 includes a substantially cylindrical outer surface 74 which extends axially down to corner 75. Lower annular surface 76 is planar and substantially perpendicular to surface 74. Lip 77 which has a rounded shape in lateral section extends radially inwardly toward lip 65. The innermost edge of lip 77 is circular and its geometric center is located on a horizontal line 78 which intersects the geometric center of tip 67. The upper surface 81 of wall 41 is substantially planar and substantially perpendicular to outer surface 74. The corner 82 between surfaces 81 and 74 is chamfered with a 45 degree angle for corner clearance with outer ring 25, see FIG. 9.

Connecting wall 42 has a substantially planar upper surface 83 which is substantially parallel with upper surface 81. Lower surface 84 of wall 42 is substantially parallel to upper surface 83 with the exception of angled, annular sealing lip 85. Sealing lip 85 is downwardly inclined into channel 44 as it extends radially outwardly toward annular portion 70. Upper surface 83 extends radially outwardly to lip 87. Curved recess 88 is disposed beneath lip 87 and smoothly transitions into upper surface 81.

Referring now to FIG. 9, cap 24, outer ring 25, and the cylindrical wall 43 which defines outlet opening 21 have been added to the FIG. 8 view. As should be clear from the enlarged details of the FIG. 9 drawing, the cap is threadedly received by portion 29 of spout 23. Lip 55 fits up into channel 44 such that top surface 53 abuts up against lip 85. The curved outermost extent of lip 55 abuts up against annular portion 70. Interlocking lip 77 fits beneath lip 55 into recessed area 56 and abuts up against the outer surface 89 of wall 43. Wall 41 and lip 77 are undersized relative to flange 37 in order to ensure a tight, interference fit on flange 37 and an interlocked arrangement beneath lip 55. Inner wall 40 abuts up against cylindrical surface 52 such that tips 66 and 67 are compressed into sealing engagement against surface 52. The radial separation distance between lip 77 and tip 67 is smaller than the radial width of wall 43 below lip 55. As such, there is an interference fit of wall 43 up into channel 44. This interference fit which is seen on both sides of wall 43 where lip 77 makes contact and where tip 67 makes contact creates a compressive clamping force to enhance the liquid-tight seal. Since tip 66 is also compressed against surface 52, this sealed interface provides a secondary or safety seal which enhances the liquid-tight relationship between spout 23 and wall 43. The abutment of sealing lip 85 against top surface 53 provides a yet further secondary or safety seal. Sealing lip 85 is provided to accommodate height variations in wall 43 and lip 55.

The interference fit of wall 43 up into channel 44 combined with the interlock positioning of lip 77 beneath lip 55 creates a secure assembly of the spout 23 onto wall 43. This sealed combination remains intact even with the repeated cycling of spout 23 from a nested orientation to an extended orientation and then back to a nested orientation.

Outer ring 25 completes the assembled combination and includes an annular outer wall 92 which extends axially in a downward direction into lip 93. Lip 93 protrudes inwardly and locks beneath corner 75. Inner rib 94 seats on top of upper surface 81 and there is actually a sandwiching or clamping action by outer ring 25 onto outer wall 41. Once snapped in place on outer wall 41, the outer ring 25 is securely assembled and has no freedom of movement in an axial direction. The outer ring 25 remains snap-locked onto and around wall 41 and over wall 43 even after the frangible elements are severed and the bail handles are freed.

The assembly of the outer ring 25 onto wall 41 is important as a means to reinforce wall 41 and its snap-fit assembly onto wall 43. Any tendency of walls 40 and 41 to deflect or separate which might loosen their hold onto wall 43 is restrained by outer ring 25. There is no place for wall 41 to go as it is securely locked in position both axially and radially.

In actual practice the cap 24 and outer ring 25 combination are first assembled to spout 23. The cap 24 is threaded onto wall 31 and the outer ring 25 is snapped around wall 41. This assembly is then pushed into a locked position on wall 43. The snap-fit assembly of lip 55 into channel 44 anchors the spout onto the neck finish (wall 43) of container 20.

The present invention employs a number of novel and unobvious features which make closure 22 particularly appropriate for its intended application. To begin with, the cylindrical surface 52 of neck finish wall 43 is likely the most uniform and consistent dimension among current manufacturers. The sealing beads which are provided by tips 66 and 67 are specifically designed with a press fit against cylindrical surface 52. The various portions of flange 37 are sized such that there will be an interference fit against surface 52, even if surface 52 is at is largest expected size. The specific thickness and size of wall 41 was selected in order to provide a strengthening mass for tips 66 and 67 to strengthen the press fit and the sealed interface. The thicker wall provided to inner wall 40 results in an increased hoop strength to that wall, thereby tending to hold the tips 66 and 67 in compressed and liquid-tight contact against surface 52. The sealing bead (tip 67) is located on the same horizontal line 78 as lip 77 and as the greater or increased wall thickness of wall 40. This is a unique arrangement and helps to ensure a compressive force of tip 67 against surface 52. Lip 77 provides a mechanical lock and is dimensioned so as to be undersized in order to purposefully create a clamping force and as a result an enhanced seal. This particular design allows for a variable thickness with wall 43, thereby permitting the present invention to be suitable for use with containers which may be produced by different fabrication methods by different manufacturers. With regard to other possible dimensional variations, the axial height of wall 43 and in particular the axial thickness of lip 55 may vary between manufacturers and different manufacturing methods. For this reason, sealing lip 85 has been provided on the lower surface of connecting wall 42.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An all-plastic closure for snap-fit attachment to a raised neck finish of a container, said neck finish having an inner surface defining an opening and having a lip portion with a recessed area axially beneath said lip portion, said closure comprising:

a unitary dispensing spout having an outer flange, a centertube portion through which container contents are dispensed, and a connecting body portion disposed between the outer flange and the centertube portion, said outer flange including inner and outer walls joined by an upper wall which together define an inverted channel and said centertube being threaded;

a unitary, threaded closing cap arranged and constructed to be threadedly assembled onto said centertube portion for closing said dispensing spout;

a unitary, outer ring assembled onto and around said outer flange with a snap-fit arrangement; and wherein the channel of said outer flange is designed and constructed to snap over and around the raised neck finish, said inner and outer walls being sized relative to said raised neck so as to create a compressive fit against said raised neck for establishing a liquid-tight interface between said closure and said container.

2. The closure of claim 1 wherein said closing cap includes a pair of oppositely disposed bail handles pivotally hinged to a cap body portion.

3. The closure of claim 2 which further includes a plurality of frangible elements connecting an inner edge of said outer ring to an outer edge of each bail handle.

4. The closure of claim 1 wherein the outer wall of said outer flange includes an inwardly directed lip which is positioned in said recessed area and which interlocks with the lip portion of said neck finish.

5. The closure of claim 4 wherein the inner wall of said outer flange includes an outwardly directed sealing bead.

6. The closure of claim 5 wherein said sealing bead is substantially horizontally coplanar with said lip.

7. The closure of claim 6 wherein said closing cap includes a pair of oppositely disposed bail handles pivotally hinged to a cap body portion.

8. The closure of claim 7 which further includes a plurality of frangible elements connecting an inner edge of said outer ring to an outer edge of each bail handle.

9. A closure for attachment to a raised neck finish of a container, said neck finish having a substantially cylindrical inner surface defining a substantially cylindrical opening and having a radially-extending lip portion with a recessed area axially beneath said lip portion, said closure comprising:

a dispensing spout having a dispensing opening and an outer flange including inner and outer annular walls joined by an annular upper wall which together define an inverted channel;

a unitary closing cap designed and constructed to assemble to said dispensing spout for closing said dispensing spout;

a unitary, annular outer ring assembled onto and around said outer flange with a snap-fit arrangement; and wherein the annular channel of said outer flange is designed and constructed to snap over and around the raised neck finish, said inner and outer walls being sized relative to said raised neck so as to create a compressive fit against said raised neck for establishing a liquid-tight interface between said closure and said container.

10. The closure of claim 9 wherein said closing cap includes a pair of oppositely disposed bail handles pivotally hinged to a cap body portion.

11. The closure of claim 10 which further includes a plurality of frangible elements connecting an inner edge of said outer ring to an outer edge of each bail handle.

12. The closure of claim 9 wherein the outer wall of said outer flange includes an inwardly directed annular lip which is positioned in said annular recessed area and which interlocks with the lip portion of said neck finish.

13. The closure of claim 12 wherein the inner wall of said outer flange includes an outwardly directed sealing bead.

14. The closure of claim 13 wherein said sealing bead is substantially horizontally coplanar with said lip.

15. The closure of claim 14 wherein said closing cap includes a pair of oppositely disposed bail handles pivotally hinged to a cap body portion.

16. The closure of claim 15 which further includes a plurality of frangible elements connecting an inner edge of said outer ring to an outer edge of each bail handle.

17. In combination:

a container having a raised neck finish which includes a substantially cylindrical inner surface defining a substantially cylindrical opening and having a radially-extending lip portion with a recessed area axially beneath said lip portion; and a closure attached to said container with a snap-fit assembly onto said raised neck finish, said closure comprising:

a unitary nestable and extendable dispensing spout having an outer flange, a centertube portion through which container contents are dispensed, and a connecting body portion disposed between the outer flange and the centertube portion, said outer flange including inner and outer walls joined by an upper wall which together define an inverted channel and said centertube being threaded;

an unitary, threaded closing cap arranged and constructed to be threadedly assembled onto said centertube portion for closing said dispensing spout;

a unitary, annular outer ring assembled onto and around said outer flange with a snap-fit arrangement; and wherein the channel of said outer flange is designed and constructed to snap over and around the raised neck finish, said inner and outer walls being sized relative to said raised neck so as to create a compressive fit against said raised neck for establishing a sealed interface between said closure and said container.

18. The combination of claim 17 wherein the outer wall of said outer flange includes an inwardly directed annular lip which is positioned in said annular recessed area and which interlocks with the lip portion of said neck finish.

19. The combination of claim 18 wherein the inner wall of said outer flange includes an outwardly directed sealing bead which sealing bead is substantially horizontally coplanar with said annular lip.

20. In combination:

a container having a raised neck finish which includes an inner surface defining an opening and having a radially-extending lip portion with a recessed area axially, beneath said lip portion; and a closure attached to said container with a snap-fit assembly onto said raised neck finish, said closure comprising:

a dispensing spout having a dispensing opening and an outer flange including inner and outer walls joined by an upper wall which together define an inverted channel;

a unitary closing cap designed and constructed to assemble to said dispensing spout for closing said dispensing spout;

a unitary, annular outer ring assembled onto and around said outer flange with a snap-fit arrangement; and wherein the inverted channel of said outer flange is designed and constructed to snap over and around the raised neck finish, said inner and outer walls being sized relative to said raised neck so as to create a compressive fit against said raised neck for establishing a liquid-tight interface between said closure and said container.

21. The combination of claim 20 wherein the outer wall of said outer flange includes an inwardly directed annular lip which is positioned in said annular recessed area and which interlocks with the lip portion of said neck finish.

22. The combination of claim 21 wherein the inner wall of said outer flange includes an outwardly directed sealing bead which sealing bead is substantially horizontally coplanar with said annular lip.

* * * * *